United States Patent [19]

Kato et al.

[11] Patent Number: 4,650,645

[45] Date of Patent: Mar. 17, 1987

[54] HEAT-RESISTING STEELS

[75] Inventors: Tetsuo Kato, Nagoya; Susumu Isobe, Chita; Kenkichi Matsunaga, Nagoya, all of Japan

[73] Assignee: Daido Steel Company Limited, Japan

[21] Appl. No.: 677,326

[22] Filed: Dec. 3, 1984

Related U.S. Application Data

[63] Continuation-in-part of Ser. No. 608,317, Apr. 25, 1984, abandoned.

[30] Foreign Application Priority Data

Apr. 28, 1983 [JP] Japan ..... 58-73769

[51] Int. Cl.[4] ..... C22C 38/24; C22C 38/22

[52] U.S. Cl. ..... 420/111; 420/90; 420/91; 420/112; 420/113; 420/109; 420/110; 420/108; 420/83

[58] Field of Search ..... 75/126 E, 126 Q, 126 G, 75/126 C, 125, 128 V, 128 U, 128 C, 128 E, 128 G; 148/36

[56] References Cited

U.S. PATENT DOCUMENTS 3,713,905 1/1973 Philip et al. ..... 75/125

3,926,622 12/1975 Kiyonaga et al. ..... 75/126 E

FOREIGN PATENT DOCUMENTS 48-3727 2/1973 Japan ..... 75/126 G
58-171556 10/1983 Japan ..... 75/126 E
0494841 11/1938 United Kingdom ..... 148/36
0495387 4/1976 U.S.S.R. ..... 75/126 G
0703224 12/1979 U.S.S.R. ..... 75/128 E
0707988 1/1980 U.S.S.R. ..... 75/125
0840187 6/1981 U.S.S.R. ..... 75/128 E

*Primary Examiner*—L. Dewayne Rutledge
*Assistant Examiner*—Deborah Yee
*Attorney, Agent, or Firm*—Sughrue, Mion, Zinn, Macpeak, and Seas

[57] ABSTRACT

A heat-resisting steel suitable for use in valve parts of internal combustion engine is disclosed, which consists essentially by weight percentage of 0.3–0.5% of C, more than 1.0% to 2.5% of Si, 0.1–2.0% of Mn, 0.5–7.0% of Cr, 0.3–2.0% of Mo and 0.1–1.0% of V as basic ingredients, at least one of 0.3–2.0% of Cu and 0.001–0.05% of REM as sub-ingredients and if necessary, at least one of 0.1 to less than 2.0% of Ni, 0.1–1.5% of W and 0.03–1.0% of Nb+Ta, and the balance of Fe and inevitable impurities.

15 Claims, 1 Drawing Figure

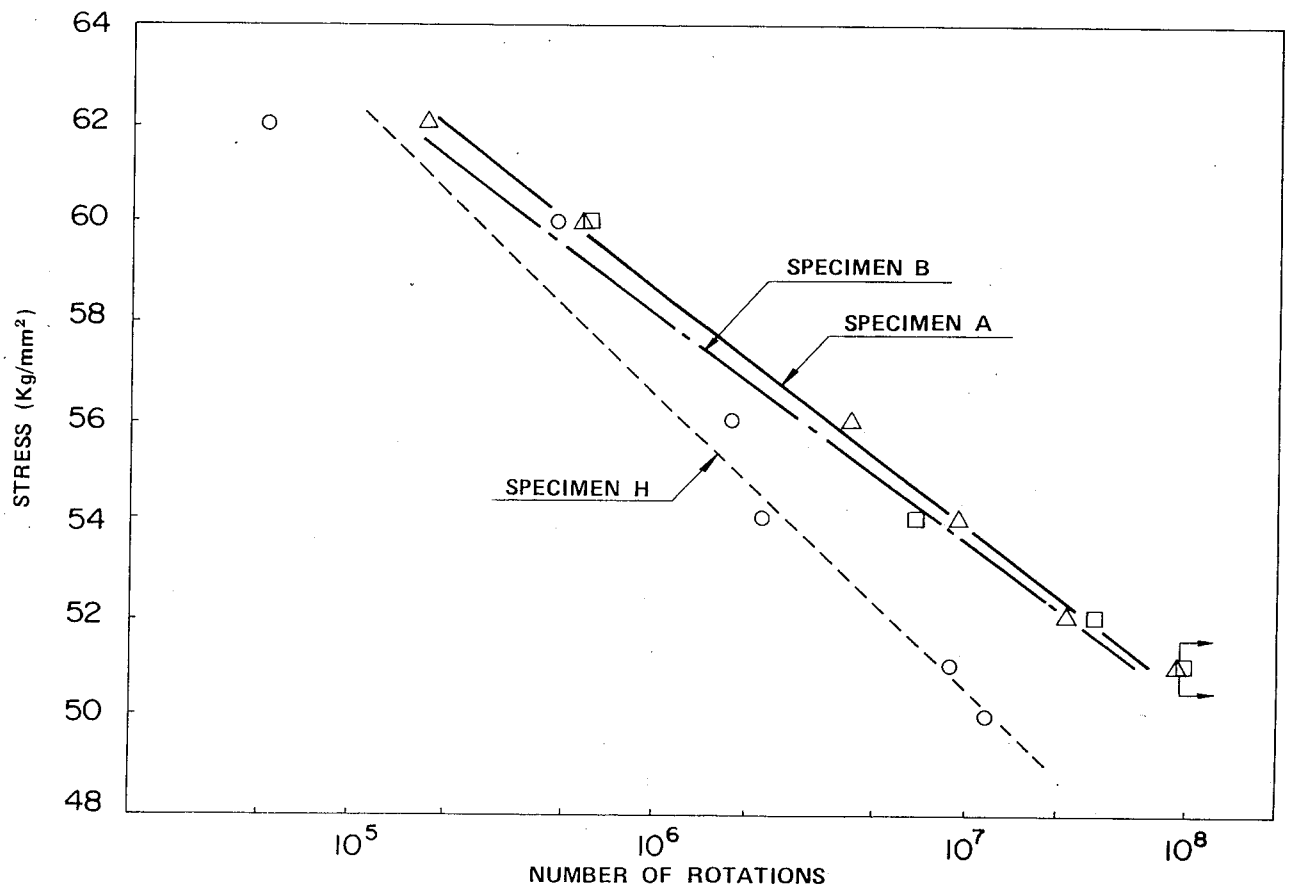
SPECIMEN B
SPECIMEN A
SPECIMEN H
STRESS (kg/mm²)
64
62
60
58
56
54
52
50
48
10⁵
10⁶
10⁷
10⁸
NUMBER OF ROTATIONS

HEAT-RESISTING STEELS

This is a continuation-in-part of application Ser. No. 06/608,317, filed Apr. 25th, 1984, now abandoned.

BACKGROUND OF THE INVENTION

1. Field of the Invention

This invention relates to a heat-resisting steel having excellent strength and corrosion resistance, and more particularly to a heat-resisting steel having improved properties as a valve material for use in valve component parts of an internal combustion engine.

2. Description of the Prior Art

Heretofore, heat-resisting steels such as SUH 1, SUH 3, SUH 11 and the like have largely been used in an intake valve for an internal combustion engine such as gasoline engine, diesel engine or the like. Lately, it is required to use materials having excellent high-temperature strength and oxidation resistance as a valve material with the increase of compression ratio in the engine (or the use of turbo or diesel engine), and these materials are required to have a cold forging property in view of the improvement of productivity. However, the aforementiond SUH series steels are still insufficient to satisfy the above requirements. Further, all of these steels contain 8 to 12% of chromium, while chromium producing district is restricted considerably, so that there is a great fear on the acquisition of chromium.

SUMMARY OF THE INVENTION

It is, therefore, an object of the invention to solve the aforementioned problems of the prior art and to provide a heat-resisting steel having a smaller content of chromium which is advantageous in the cost and acquisition of raw material, and has high-temperature properties substantially equal to those of the existing SUH 1 steel, and is possible in the cold forging, and is suitable as a material for intake valve or heat-resistant bolt.

That is, the heat-resisting steel according to the invention consists essentially by weight percentage of 0.3–0.5% of carbon, more than 1.0 to 2.5% of silicon, 0.1–2.0% of manganese, 0.5–7.0% of chromium, 0.3–2.0% of molybdenum and 0.1–1.0% of vanadium as basic ingredients, at least one of 0.3–2.0% of copper and 0.001–0.05% in total of at least one rare earth metal (hereinafter referred to as REM) as subingredients, and if necessary at least one auxiliary ingredient selected from 0.1 to less than 2.0% of nickel, 0.1–1.5% of tungsten and 0.03–1.0% of niobium+tantalum, and the balance of iron and inevitable impurities. Upon the appropriateness of carbon and silicon contents and the addition of copper and REM, the heat-resisting steel according to the invention has high-temperature properties equal to those of the conventional SUH 1 steel and excellent cold forging properties and is suitable for use in high-load intake valve, heat-resistant bolt, heat-resisting parts and the like.

DETAILED DESCRIPTION OF THE INVENTION

According to the invention, the reason for limiting the chemical composition of the heat-resisting steel to the ranges (in weight ratio) as mentioned above is as follows:

Carbon: 0.3–0.5%

Carbon is an effective element for increasing the strength of matrix, so that it is necessary to be added in an amount of not less than 0.3%. However, when carbon is added in an amount of more than 0.5%, not only the corrosion resistance but also the cold forging property are deteriorated.

Silicon: <1.0 to 2.5%

Silicon is an effective element as a deoxidizing agent during melt refining and improves the tensile strength and fatigue strength. In order to ensure that the high temperature, fatigue strength, oxidation resistance, and corrosion resistance against PbO does not become undesirably low silicon must be added in an amount of more than 1.0%, such as at least 1.2%, preferably at least 1.5%, and still more preferably at least 1.7%. At these silicon values, the tensile strength is improved. However, when the silicon content exceeds 2.5%, the toughness and cold forging property as well as the cutting property are deteriorated.

Manganese: 0.1–2.0%

Manganese is an effective element as a deoxidizing-desulfurizing agent during melt refining and contributes to improve the quenching property for the increase of the strength. For this purpose, manganese must be added in an amount of not less than 0.1%. However, when the manganese content exceeds 2.0%, the oxidation resistance degrades.

Chromium: 0.5–7.0%

Chromium is an element necessary for ensuring the corrosion resistance and oxidation resistance required in the heat-resisting steel and particularly is an effective element for improving the oxidation resistance and corrosion resistance required in the intake valve. For this purpose, chromium must be added in an amount of not less than 0.5%. However, when chromium is added in an amount of more than 7.0%, the resistance to temper softening lowers and the cold formability is deteriorated and further the cost rises. In order to restrain the cost-up, the chromium content is desirable to be within a range of 0.5–3.0%, preferably 0.5 to 1.9%, such as 0.5 to 1.5%, and still more preferably 0.5 to 1.1%.

Molybdenum: 0.3–2.0%

Molybdenum is an effective element for improving the resistance to temper softening to enhance the high-temperature strength. For this purpose, molybdenum must be added in an amount of not less than 0.3%. However, when the molybdenum content exceeds 2.0%, the addition effect is not developed and the cost becomes high.

Vanadium: 0.1–1.0%

Vanadium is an effective element for improving the high-temperature strength. Particularly, vanadium serves together with molybdenum to supplement the reduction of the strength due to the decrease of chromium content. For this purpose, vanadium must be added in an amount of not less than 0.1%. However, when the vanadium content exceeds 1.0%, the toughness and cold forging property degrade.

Copper: 0.3–2.0%, REM: 0.001–0.05%

Copper and REM are elements effective for supplementing the reduction of the corrosion resistance and strength due to the decrease of chromium content, and are particularly elements contributing to improve the oxidation resistance and fatigue strength. In order to provide such effects, it is necessary to add not less than 0.3% of copper and not less than 0.001% in total of at least one REM. However, when the copper content exceeds 2.0%, not only the hot and cold forging properties are deteriorated, but also the fatigue strength lowers. While, when the REM content exceeds 0.05%, the hot forging proerty is deteriorated and also the strength lowers.

Nickel: 0.1 to <2.0%, Tungsten: 0.1–1.5%, Niobium+Tantalum: 0.03–1.0%

All of nickel, tungsten and niobium+tantalum (including one element is none) are elements effective for improving the high-temperature strength. Further, nickel has an effect of improving the toughness as a solid solution in steel. For this purpose, nickel, tungsten and niobium+tantalum must be added in amounts of not less than 0.1%, not less than 0.1% and not less than 0.03%, respectively. However, when the nickel content is 2.0% or more, the hot workability and cold forging property deteriorates and becomes lower. Preferably, this nickel content is 1.98% or less, such as 0.43%. When the nickel content exceeds 2.0%, the toughness deteriorates. Further, when the tungsten and niobium+tantalum contents exceed 1.5% and 1.0%, respectively, the toughness, hot workability and cold forging property are deteriorated. In any case, at least one of nickel, tungsten and niobium+tantalum is added within the above ranges.

Besides, at least one of 0.03–0.3% of sulfur and 0.001–0.02% of calcium may be added in order to improve the cutting property of steel.

EXAMPLE

Next, the invention will be described in detail with reference to the following examples and comparative examples.

In a small size high-frequency induction furnace was melted 50 kg of a steel ingot having a chemical composition as shown in the following Table 1, which was shaped into a slab and subjected to a hot forging to obtain a round rod of 20 mm in diameter.

TABLE 1

| specimen | Chemical composition (% by weight) | | | | | | | | |
|---|---|---|---|---|---|---|---|---|---|
| | C | Si | Mn | Cu | Cr | Mo | V | REM | others |
| A | 0.45 | 1.77 | 0.80 | 0.87 | 1.00 | 0.80 | 0.30 | — | — |
| A' | 0.45 | 0.70 | 0.81 | 0.98 | 1.01 | 0.80 | 0.31 | — | — |
| B | 0.44 | 1.75 | 0.60 | 0.02 | 1.00 | 0.80 | 0.30 | 0.018 | — |
| B' | 0.44 | 0.73 | 0.80 | 0.03 | 1.01 | 0.81 | 0.30 | 0.019 | — |
| C | 0.44 | 1.75 | 0.57 | 0.85 | 1.08 | 0.81 | 0.29 | 0.010 | — |
| D | 0.45 | 1.76 | 0.58 | 0.99 | 1.04 | 0.80 | 0.30 | — | W: 1.0 |
| D' | 0.45 | 0.72 | 0.59 | 0.98 | 1.03 | 0.80 | 0.29 | — | W: 1.0 |
| E | 0.44 | 1.70 | 0.61 | 0.82 | 1.00 | 0.59 | 0.30 | 0.014 | W: 0.98 |
| F | 0.44 | 1.74 | 0.60 | 1.02 | 1.00 | 0.59 | 0.31 | — | Ni: 0.43 |
| F' | 0.44 | 1.75 | 0.81 | 1.01 | 1.00 | 0.60 | 0.32 | — | Ni: 1.98 |
| F'' | 0.44 | 1.75 | 0.81 | 1.02 | 1.00 | 0.58 | 0.30 | — | Ni: 2.5 |
| G | 0.48 | 1.75 | 0.80 | 0.01 | 1.01 | 0.60 | 0.30 | 0.008 | Nb: 0.52 |
| H | 0.44 | 1.74 | 0.80 | 0.01 | 1.00 | 0.80 | 0.28 | — | — |
| I | 0.48 | 1.75 | 0.81 | 0.02 | 0.98 | 0.61 | 0.29 | — | Nb: 0.81 |

Then, the resulting round rod was quenched at 954° C. and tempered at a temperature of 700°–750° C. so as to obtain a Rockwell hardness (HrC) of 32 and then tested in the following manner with respect to (1) high-temperature fatigue property, (2) high-temperature tensile properties, (3) oxidation resistance and (4) corrosion resistance.

(1) High-temperature fatigue property

The high-temperature fatigue strength is a most important property as a valve material. Now, the fatigue strength at 427° C., which being a temperature in the use of the valve, was measured with respect to each of the above specimens by using an Ono's rotation bending fatigue tester to thereby obtain results as shown in the folowing Table 2 and the accompanying drawing. In Table 2, the fatigue strength is represented as a breaking stress at $10^7$ cycles, and single FIGURE shows an S-N curve at 427° C.

TABLE 2

| Specimen | Breaking stress at $10^7$ cycles (kgf/mm$^2$) |
|---|---|
| A | 54.0 |
| A' | 51.3 |
| B | 53.8 |
| B' | 51.2 |
| C | 54.5 |
| D | 54.5 |
| D' | 52.0 |
| E | 55.1 |
| F | 54.1 |
| F' | 54.5 |
| F'' | 53.9 |
| G | 55.3 |
| H | 50.8 |
| I | 50.5 |

As apparent from Table 2, the high-temperature fatigue strength of the invention steels A–G and F' is higher than that of the comparative steels A', B', D' H and I.

As shown in the single FIGURE, when the invention steels A and B containing Cu or REM are compared with the comparative steel H containing no Cu and REM, there is not a great difference in the fatigue strength at high stress in short time, but there is a great difference in the fatigue strength at low stress in long time. This fact clearly shows that the invention steels have an excellent high-temperature fatigue strength, and is considered to be based on the effect of improving the oxidation resistance by the addition of Cu and REM as mentioned later.

(2) High-temperature tensile properties

The tensile properties were examined at 500° C. with respect to the invention steels A–G and the existing steel SUH 11 for use in intake valve to obtain a result as shown in the following Table 3. Moreover, SUH 11 steel was heat-treated under such conditions that it was kept at 1020° C. for 0.5 hour, oil-quenched, kept at 750° C. for 1 hour and air-cooled.

TABLE 3

| Specimen | 0.2% offset proof stress (kgf/mm$^2$) | Tensile strength (kgf/mm$^2$) | Elongation (%) | Reduction of area (%) |
|---|---|---|---|---|
| A | 56.7 | 71.1 | 23.8 | 78.6 |
| B | 57.4 | 71.0 | 22.1 | 81.4 |
| C | 57.5 | 69.4 | 22.3 | 84.0 |
| D | 57.8 | 70.9 | 21.0 | 83.5 |
| E | 58.5 | 71.4 | 25.2 | 83.5 |
| F | 56.7 | 69.4 | 23.8 | 81.9 |
| G | 61.0 | 73.6 | 20.5 | 75.8 |
| SUH11 | — | 55.0 | 22.5 | 78.5 |

As apparent from Table 3, the high-temperature tensile properties of the invention steels A–G are superior to those of the conventional SUH 11 steel having a high chromium content.

(3) Oxidation resistance

The test for oxidation resistance was made at 538° C. for 100 hours with respect to each of the specimens A–I, A', B', D', F' and F'' to obtain a result as shown in the following Table 4.

TABLE 4

| Specimen | Oxidation loss (mg/cm$^2$) |
|---|---|
| A | 2.00 |
| A' | 2.46 |
| B | 2.11 |
| B' | 2.50 |
| C | 1.87 |
| D | 2.02 |
| D' | 2.51 |
| E | 1.90 |
| F | 2.01 |
| F' | 2.19 |
| F'' | 2.24 |
| G | 1.90 |
| H | 2.73 |
| I | 2.81 |

As apparent from Table 4, the invention steels A–G and F' containing at least one of Cu and REM exhibit an excellent oxidation resistance despite of the decrease of chromium content, while the decrease of chromium content in the comparative steels H, I containing essentially no Cu and no REM causes the deterioration of oxidation resistance.

(4) Corrosion resistance against PbO

Lead (Pb) may be added to gasoline for increasing the octane number thereof. In this case, abnormal corrosion due to the attack of PbO is produced in the valve. Therefore, the corrosion resistance against PbO is an important property in the heat-resisting steel for use in the valve. Now, the attack test of PbO was made with respect to each specimen under conditions of 538° C./50 hours to obtain a result as shown in the following Table 5.

TABLE 5

| specimen | Corrosion loss (mg/cm$^2$) |
|---|---|
| A | 8.19 |
| A' | 18.65 |
| B | 11.80 |
| B' | 19.31 |
| C | 8.02 |
| D | 8.22 |
| D' | 18.74 |
| E | 8.14 |
| F | 8.17 |
| F' | 8.09 |
| F'' | 8.05 |
| G | 12.10 |
| H | 18.40 |
| I | 18.15 |

As apparent from Table 5, all of the invention steels A–G and F' are superior in the corrosion resistance against PbO to the comparative steels H, I. This shows that the addition of Cu and REM improves the corrosion resistance.

As mentioned above, in the heat-resisting steel according to the invention, the content of expensive chromium having a fear on acquisition is decreased and the contents of carbon and silicon are appropriated and also one or more of copper and REM are added, so that the reduction of the cost can be realized by the decrease of chromium content. Further, the reduction of strength due to the decrease of chromium content can be supplemented by the addition of molybdenum and vanadium, while the reduction of corrosion resistance can be supplemented by the addition of silicon, copper and REM, so that the resulting heat-resisting steels have high-temperature properties approximately equal to those of the conventional SUH 1 steel having a high chromium content and an excellent cold forging property. Therefore, they are particularly suitable as a material for intake valve, heat-resistant bolt and the like.

What we claim is:

1. A heat-resisting valve made of a steel consisting essentially by weight percentage of $0.3\% \leqq C \leqq 0.5\%$, $1.0\% < Si \leqq 2.5\%$, $0.1\% \leqq Mn \leqq 2.0\%$, $0.5\% \leqq Cr \leqq 3.0\%$, $0.3\% \leqq Mo \leqq 2.0\%$, $0.1\% \leqq V \leqq 1.0\%$, at least one element selected from the group consisting of $0.3\% \leqq Cu \leqq 2.0\%$ and $0.001\% \leqq REM \leqq 0.05\%$, and the balance of Fe and containing inevitable impurities, with REM being rare earth metal.

2. A heat-resisting valve according to claim 1, wherein said steel further contains at least one element selected from the group consisting of $0.1\% \leqq Ni < 2.0\%$, $0.1\% \leqq W \leqq 1.5\%$, $0.03\% \leqq Nb + Ta \leqq 1.0\%$.

3. A heat resisting valve according to claim 1, wherein the Si is present in an amount of at least 1.2%.

4. A heat resisting valve according to claim 1, wherein the Si is present in an amount of at least 1.5%.

5. A heat resisting valve according to claim 1, wherein the Si is present in an amount of at least 1.7%.

6. A heat resisting valve according to claim 2, wherein the Ni is present in an amount not greater than 1.98%.

7. A heat resisting valve according to claim 2, wherein the Ni is present in an amount of 0.1% to 0.43%.

8. A heat resisting valve according to claim 2, wherein the Ni is present in an amount of 0.43%.

9. A heat resisting valve according to claim 8, wherein the Si is present in an amount of at least 1.7%.

10. A heat resisting valve according to claim 8, wherein the Si is present in an amount of 1.74%.

11. A heat resisting valve according to claim 2, wherein the Ni is present in an amount not greater than 0.43%.

12. A heat resisting valve according to claim 11, wherein the Si is present in an amount of at least 1.7%.

13. A heat resisting valve according to claim 1, wherein Cr is present in an amount of no more than 1.9%.

14. A heat resisting valve according to claim 1, wherein Cr is present in an amount of no more than 1.5%.

15. A heat resisting valve according to claim 1, wherein Cr is present in an amount of no more than 1.1%.

* * * * *